US008439559B2

(12) United States Patent
Luk et al.

(10) Patent No.: US 8,439,559 B2
(45) Date of Patent: May 14, 2013

(54) TIMEPIECE WITH MULTI-FUNCTIONAL ACTUATOR

(75) Inventors: Tai Wai Luk, Hong Kong (HK); Quang Yin Zeng, Ji An (CN)

(73) Assignee: Bright Aggregation Technology Limited, Kowloon Bay, Kowloon (HK)

( * ) Notice: Subject to any disclaimer, the term of this patent is extended or adjusted under 35 U.S.C. 154(b) by 524 days.

(21) Appl. No.: 12/729,459

(22) Filed: Mar. 23, 2010

(65) Prior Publication Data

US 2011/0235471 A1 Sep. 29, 2011

(51) Int. Cl.
*G04B 29/00* (2006.01)

(52) U.S. Cl.
USPC ..... 368/308; 368/321

(58) Field of Classification Search ..... 368/69, 368/185, 190, 206, 308, 319–321
See application file for complete search history.

(56) References Cited

U.S. PATENT DOCUMENTS 4,313,187 A * 1/1982 Waki et al. ..... 368/319
4,396,294 A * 8/1983 Yoshida ..... 368/71
5,043,958 A * 8/1991 Kaelin ..... 368/321
5,305,291 A * 4/1994 Kamens et al. ..... 368/252
5,473,580 A * 12/1995 Gilomen et al. ..... 368/28
5,644,553 A * 7/1997 Cuinet ..... 368/320
6,200,020 B1 * 3/2001 Rieben ..... 368/290
6,227,700 B1 * 5/2001 Hunziker et al. ..... 368/321
6,902,169 B2 * 6/2005 Wild ..... 277/602
7,210,845 B2 * 5/2007 Oesch et al. ..... 368/320
7,357,569 B2 * 4/2008 Yoshikawa ..... 368/308
7,540,655 B2 * 6/2009 Speichinger ..... 368/190
7,862,226 B2 * 1/2011 Bracher et al. ..... 368/190
7,909,503 B2 * 3/2011 Hiranuma ..... 368/308
2002/0024887 A1 * 2/2002 Triponez ..... 368/35

* cited by examiner

*Primary Examiner* — Vit W Miska
(74) *Attorney, Agent, or Firm* — Tsz Lung Yeung

(57) ABSTRACT

An analog timepiece includes a casing, a time displaying device, an electronic device received in the casing, a main control unit (MCU) communicated with the time displaying device and the electronic device for selectively controlling an operation of the time displaying device and sad electronic device and a multi-functional actuator. The multi-function actuator includes an actuator button movably provided on the casing to selectively move between an idle position, a time adjustment position and a triggering position, wherein in the idle position, the actuator button disengages with the MCU to allow normal operation of the electronic device, wherein in the time adjustment position, the actuator button is moved from the idle position to allow adjustment of the time displaying device, and wherein in the triggering position, the actuator is moved to engage with the MCU for triggering an operation of the electronic device.

13 Claims, 6 Drawing Sheets

TIMEPIECE WITH MULTI-FUNCTIONAL ACTUATOR

BACKGROUND OF THE PRESENT INVENTION

1. Field of Invention

The present invention relates to a timepiece, and more particularly to an analog timepiece comprising a multi-functional actuator which allows a user to selectively adjust time information and trigger an electronic device through highly convenient operations on the multi-functional actuator.

2. Description of Related Arts

A conventional timepiece, such as a conventional analog watch, usually comprises a casing and a time displaying device for displaying time and date information. The casing usually has an adjustment stem extended therefrom in which a user is able to pull out the adjustment stem to temporarily stop the operation of the time displaying device and make adjustment to the displayed time. After the adjustment, the user has to manually and inwardly push the adjustment stem back to its original position so as to resume the operation of the adjustment stem.

For this kind of conventional analog watch, the adjustment stem can only perform the above-mentioned function (i.e. adjustment of the time displaying device). When the conventional analog watch includes other functions, such as an electronic function, the operation of that electronic function must be accomplished by actuators other than the adjustment stem. For example, when the conventional analog watch includes an illumination function, the operation (the switching on or off) of the relevant LED received in the casing must be controlled by actuating another actuator, such as a predetermined button provided on the casing. This brings great inconvenience to users of conventional analog watches.

SUMMARY OF THE PRESENT INVENTION

A main object of the present invention is to provide an analog timepiece comprising a multi-functional actuator which allows a user to selectively adjust time information and trigger an electronic device through highly convenient operations on the multi-functional actuator.

Another object of the present invention is to provide an analog timepiece comprising a multi-functional actuator, wherein a user is allowed to selectively operate two separate functions through simple operation of a single multi-functional actuator. More specifically, the multi-functional actuator is axially displaced in opposite directions to selectively allow time adjustment and actuation of an electronic device provided within the analog timepiece respectively.

Another object of the present invention is to provide an analog timepiece comprising a multi-functional actuator, wherein the user simply needs to outwardly pull the multi-functional actuator from its idle position to adjust time information of the analog timepiece. On the other hand, the user simply needs to inwardly push the multi-functional actuator from its idle position to actuate an electronic device provided in the analog timepiece.

Another object of the present invention is to provide an analog timepiece comprising a multi-functional actuator which is arranged to combine with the function of a traditional stem of a conventional timepiece while allowing the user to actuate an electronic device. In other words, no additional actuators or buttons are used for operating two separate functions apart from the single multi-functional actuator of the present invention.

Accordingly, in order to accomplish the above objects, the present invention provides an analog timepiece, comprising:

a casing having a receiving cavity;

a time displaying device for indicating time information;

an electronic device received in the casing;

a main control unit (MCU) received in the casing and communicated with the electronic device for selectively controlling an operation of the electronic device; and a multi-functional actuator which comprises an actuator button movably provided on the casing to selectively move between an idle position, a time adjustment position and a triggering position, wherein in the idle position, the actuator button disengages with the MCU to allow normal operation of the time displaying device, wherein in the time adjustment position, the actuator button is moved from the idle position to allow adjustment of the time displaying device, and wherein in the triggering position, the actuator is moved to engage with the MCU for triggering an operation of the electronic device.

The above mentioned objectives, features, and advantages of the present invention will be more clearly described and shown in the following detailed description, drawings, and the claims.

DETAILED DESCRIPTION OF THE PREFERRED EMBODIMENT

Figure 1:
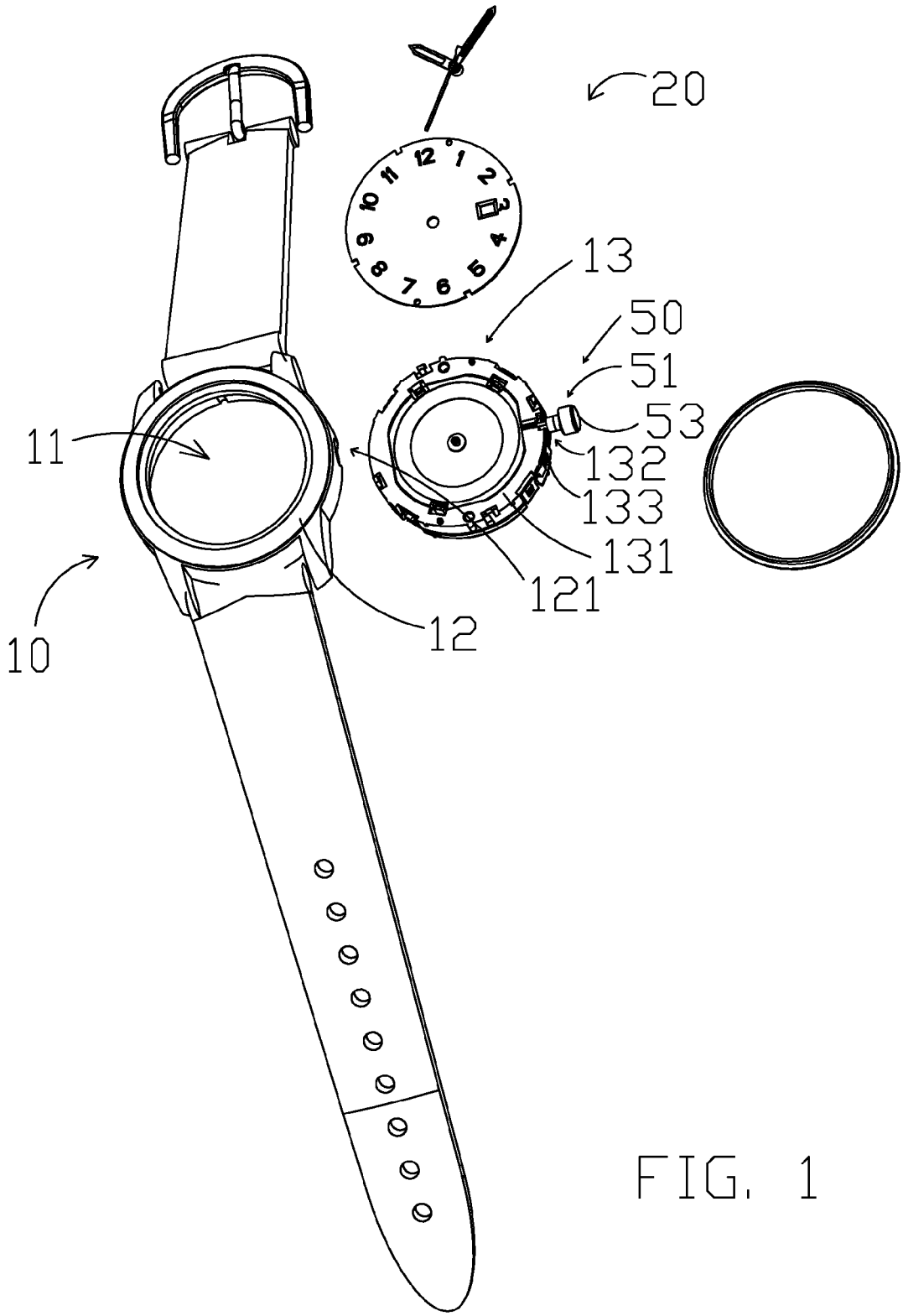
FIG. 1 is an exploded perspective view of an analog timepiece according to a preferred embodiment of the present invention.

Referring to FIG. 1, FIG. 2A to FIG. 2C, FIG. 3 and FIG. 4 of the drawings, an analog timepiece, such as an analog watch, according to a preferred embodiment of the present invention is illustrated. The analog timepiece comprises a casing 10 having a receiving cavity 11, a time displaying device 20 for indicating time information, an electronic device 30 received in the casing 10, a Main Control Unit (MCU) 40, and a multi-functional actuator 50 operatively supported by the casing 10.

The main control unit (MCU) 40 is received in the casing 10 and is electrically communicated with the electronic device 30 for selectively controlling an operation of the electronic device 30.

On the other hand, the multi-functional actuator 50 comprises an actuator button 51 movably provided on the casing 10 to selectively move between an idle position, a time adjustment position and a triggering position, wherein in the idle position, the actuator button 51 disengages with the MCU to allow normal operation of the time displaying device 20 and the electronic device 30, wherein in the time adjustment position, the actuator button 51 is outwardly moved from the idle position to allow adjustment of the time displaying device 20 through actuating the actuator button 51, and wherein in the triggering position, the actuator 51 is inwardly and longitudinally pushed from the idle position to actuate an operation of the electronic device 30.

According to the preferred embodiment of the present invention, the casing 10 is a casing for an analog watch, but it is important to emphasis that the analog timepiece of the present invention can also be embodiment as an analog clock or other kinds of timepieces, so that the casing 10 may be formed as the casing of a corresponding timepiece. The casing 10 comprises an outer casing 12 defining the receiving cavity 11, and an inner supporting frame 13 for supporting the time displaying device 20, the electronic device 30 and the MCU 40. The actuator button 51 is operatively supported by the outer casing 12 and the inner supporting frame 13 so as to operate between the three positions mentioned above. The outer casing 12 has a through slot 121 for the actuator button 51 to pass therethrough when moving between the idle position, the time adjustment position and the triggering position.

On the other hand, the inner supporting frame 13 comprises a frame member 131 defining a triggering slot 132 formed thereon at a position aligned with the through slot 121 of the outer casing 12 so that the actuator button 51 is arranged to pass through both of the through slot 121 of the outer casing 12 and the triggering slot 132 of the inner supporting frame 13 when moving between the three positions. The frame member 131 is arranged to securely support the time displaying device 20, the electronic device 30, and the MCU 40 within the receiving cavity 11.

The inner supporting frame 13 further comprises a conductive element 133 mounting at the frame member 131 at a position in the vicinity of the triggering slot 131, wherein the conductive element 133 is arranged to selectively driven to trigger the operation of the electronic device 30 when the actuator button 51 is at the triggering position. More specifically, the conductive element 133 is made of conductive materials, such as metal, and has a predetermined amount of resilient ability such that the conductive element 133 is normally retained to disengage from the electronic device 30, but when the actuator button 51 is pushed to the triggering position, the actuator button 51 is driven to move the conductive element 133 to electrically communicate with the electronic device 30 so as to trigger an operation thereof.

The time displaying device 20 comprises a timepiece core assembly 21 operatively supported within the inner casing 13, and an adjustment stem 22 movably extended from the timepiece core assembly 21 in such a manner that the adjustment stem 21 is normally retained at a predetermined position for normal operation of the timepiece core assembly 21, and can be selectively and outwardly pulled and rotated to temporarily stop the operation of the timepiece core assembly 21 and allow for time adjustment.

The MCU 40 comprises a central processor 41 and a Printed Circuit Board (PCB) 42 electrically connecting the central processor 41 with the electronic device 30, wherein the PCB 42 has a signal port 421 provided at a position aligning with the conductive element 133 so that when the conductive element 133 is pushed by the actuator button 51 at the triggering position, the conductive element 133 is arranged to be in physical contact with the signal port 421 of the PCB 42 so as to generate an actuation signal for the main processor 41 of the MCU 40 to actuate the electronic device 30. The result is that when the actuator button 51 is driven to move at the triggering position, the electronic device 30 is correspondingly actuated to operate. For example, when the electronic device 30 is an illuminating device, when the actuator button 51 is driven to move at the triggering position, the illuminating device is triggered or actuated to generate illumination for the analog timepiece. It is worth mentioning, however, that the electronic device 30 can be embodied as many other electronic devices having different functions which are controlled electronically (e.g. music generation).

It is worth mentioning that in this particular embodiment, the time displaying device 20 is a self-contained unit for displaying time and/or date information independent of the MCU 40. However, the MCU 40 can also be arranged to be electrically communicated with the time displaying device 20 so that the MCU 40 is also responsible for providing signal for display of time by the time displaying device 20. As such, the MCU 40 is electrically communicated with the time displaying device 20 and the electronic device 30 for selectively controlling the operation of the electronic device 30 and the time displaying device 20. In this scenario, the PCB 42 is also electrically connected with the time displaying device 20 for controlling an operation thereof.

The actuator button 51 comprises a stem driving member 52 securely connected with an outer end of the adjustment stem 22 of the time displaying device 20, an enlarged crown member 53 for allowing a user to manually drive the actuator button 51 to move between the idle position, and time adjustment position and the triggering position for selectively handling time adjustment and actuation of the electronic device 30, and a pusher cap 54 operatively connecting between the crown member 53 and the stem driving member 52.

Figure 2A:
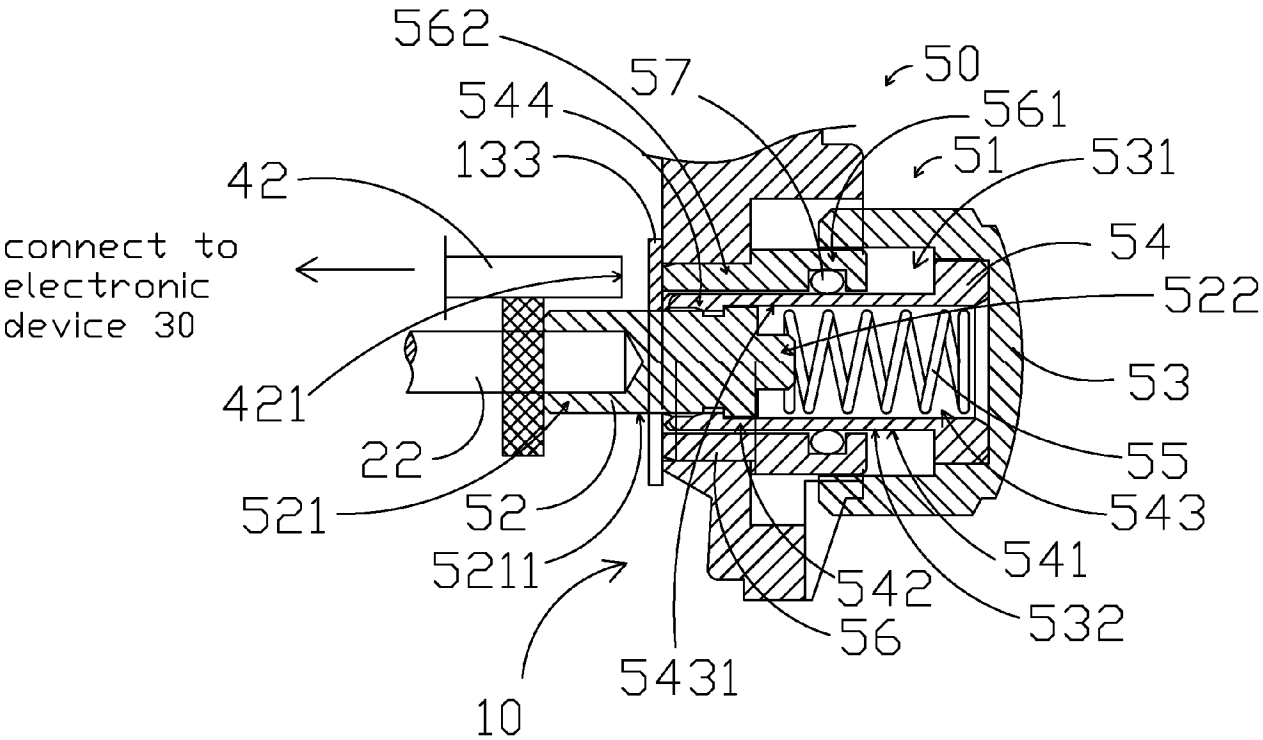
FIG. 2A to FIG. 2C are sectional side views of the analog timepiece according to the preferred embodiment of the present invention.
Figure 2B:
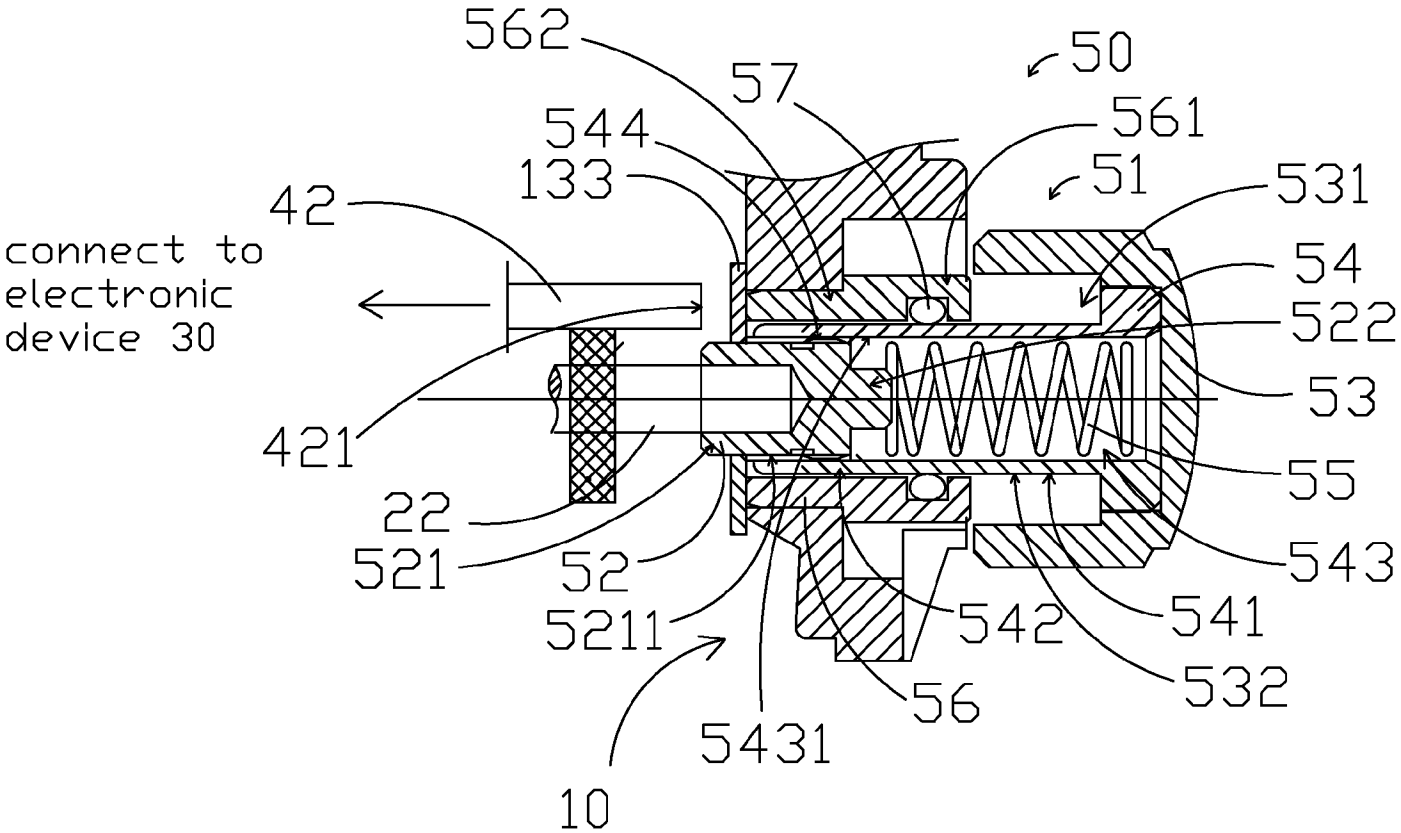
Figure 2C:
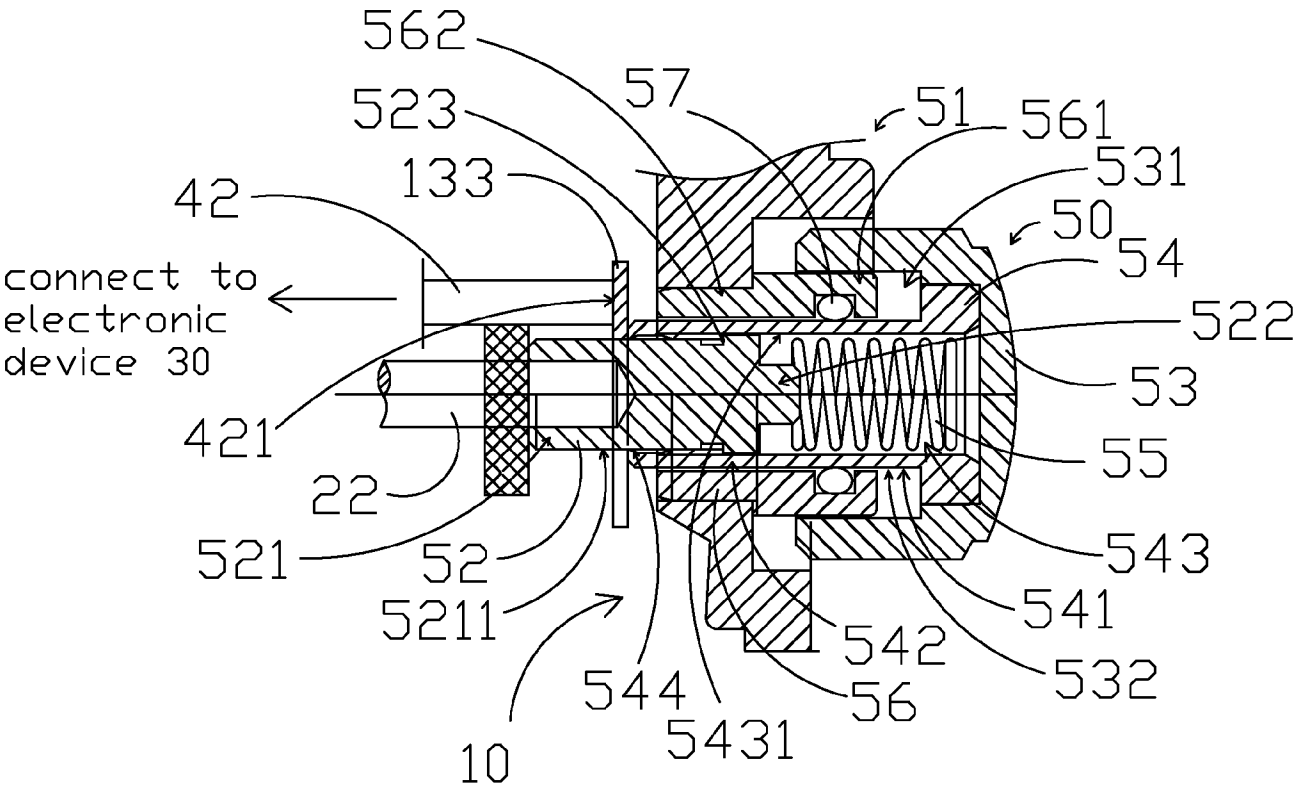

The crown member 53 has a substantially circular cross section and defines a crown cavity 531 therewithin, wherein the pusher cap 54 has an outer receiving portion 541 received within the crown cavity 531 of the crown member 53, and an inner engaging portion 542, integrally and coaxially extended out of the crown cavity 531 from the outer receiving portion 541 to reach an exterior of the crown member 53. As shown in FIG. 2A to FIG. 2C of the drawings, the pusher cap 54 has an elongated structure and an external circular cross section extended from the crown member 53 to securely engage with the stem driving member 52. An outer diameter of the pusher cap 54 is therefore smaller than an inner diameter of the crown cavity 531 of the crown member 53.

It is worth mentioning that the pusher cap 54 is arranged to conductively contact with the conductive element 133 of the inner supporting frame 13 so that when the pusher cap 54 is driven to move inwardly, the inner end of the inner engaging portion 542 is arranged to inwardly push the conductive element 133 to physically contact with the signal port 421 of the PCB 42 for triggering an operation of the electronic device 30.

Figure 3:
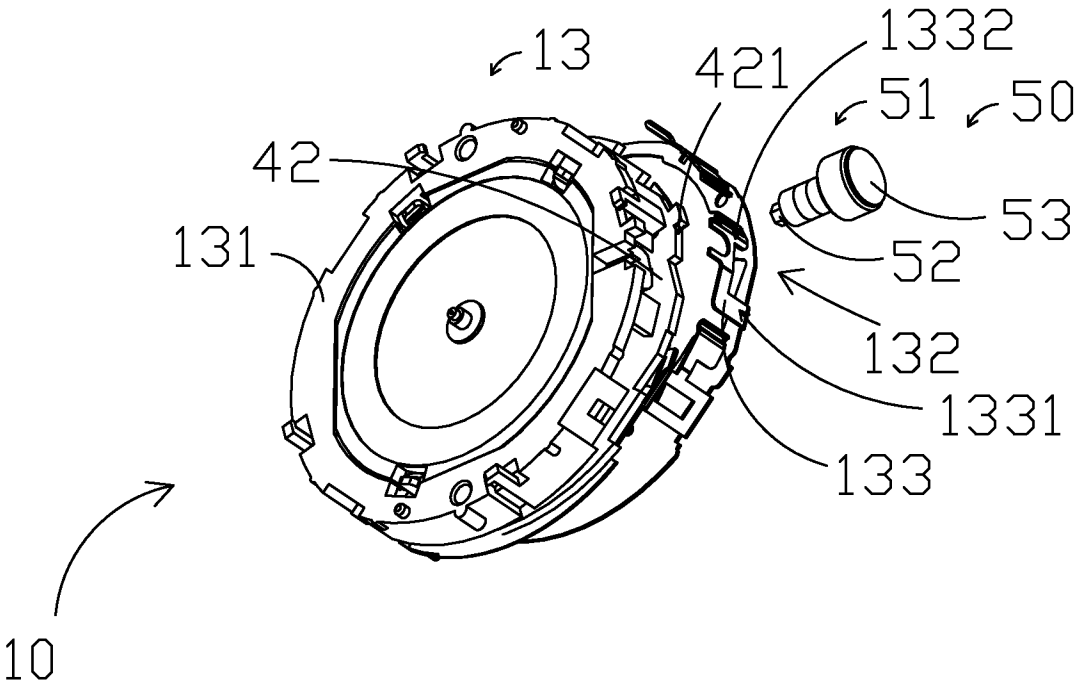
FIG. 3 is an exploded perspective view of the multi-functional actuator according to the preferred embodiment of the present invention.
Figure 4:
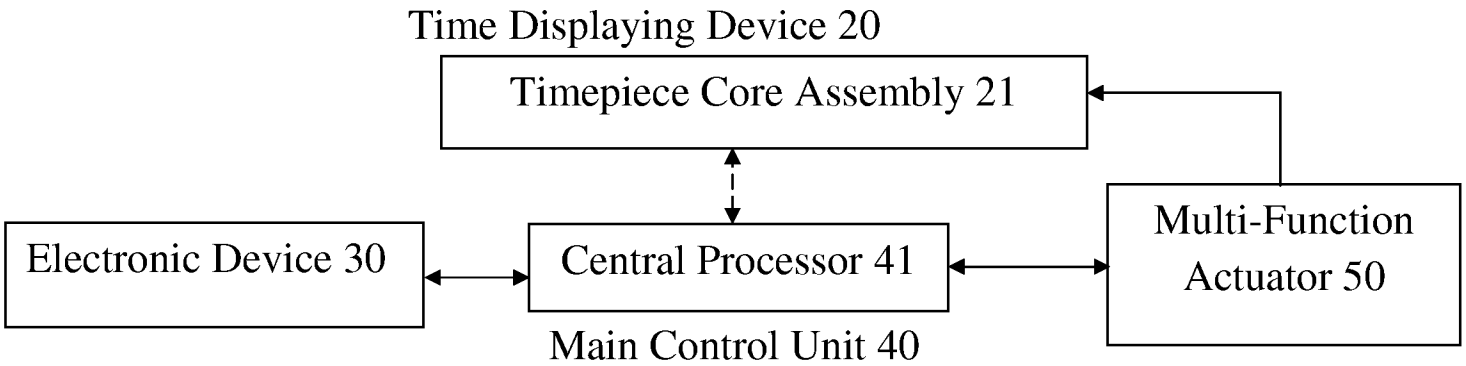
FIG. 4 is a schematic diagram of the analog timepiece according to the preferred embodiment of the present invention.

According to the preferred embodiment of the present invention, the conductive element 133 (as shown in FIG. 3), having a predetermined resilient ability, has a fixed end portion 1331 affixed at a predetermined position of the inner supporting frame 13, and a loose end portion 1332 movably extended to contact with the inner end of the inner engaging portion 542 of the pusher cap 54. The loose end portion 1331 is normally arranged to disengage with the PCB 42. But when the pusher cap 54 is driven to move inwardly, the loose end portion 1331 is slightly pushed to deform to move to contact with the signal port 421 of the PCB 42. When the driving force on the part of the pusher cap 54 is relieved, the pusher cap 54 returns to its original position, and the loose end portion 1331 automatically returns to its original position (i.e. disengaging from the signal port 421) because of its inherent resilient ability.

The multi-functional actuator 50 further comprises a resilient element 55 received in the pusher cap 54, wherein the pusher cap 54, which is cylindrical in shape (i.e. having a substantially circular cross section) has a pusher cavity 543 extended along its entire longitudinal length and defined by six surrounding sidewalls 5431. In other words, the pusher cap 54 has a hexagonal pusher cavity 543 wherein the resilient element 55 is received therein for normally exerting an outward urging force towards crown member 53 so as to normally retain the actuator button 51 at its idle position.

The pusher cap 54 further has a locking latch 544 integrally and inwardly extended from an inner side edge of the inner engaging portion 542. On the other hand, the stem driving member 52 has an inner driven portion 521 and an outer driving portion 522 having a diameter slightly larger than a diameter of the inner driven portion 521 to define a locking shoulder 523 at the intersection between the inner driven portion 521 and the outer driving portion 522, wherein the locking shoulder 523 is arranged to align with the locking latch 544 of the pusher cap so that when the pusher cap 54 is outwardly pushed with respective to the casing 10, the outward movement of the pusher cap 54 is blocked by the engagement between the locking shoulder 523 and the locking latch 544. However, when the pusher cap 54 is inwardly pushed with respective to the casing 10, the inward movement allows disengagement of the locking shoulder 523 from the locking latch 544, so as to allow the pusher cap 54 to move inwardly for pushing the conductive element 133.

It is worth mentioning that the stem driving member 52 further has six outer surfaces 5211 formed at the inner driving portion 521 for forming a corresponding hexagonal outer contour. The hexagonal contour is arranged to fittedly and slidably receive in the inner engaging portion 542 of the pusher cap 54 which has the hexagonal pusher cavity 543 defined by the six surrounding sidewalls 5431. Thus, the pusher cap 54 is capable of inwardly moved to drive the conductive element 133 yet is prevented from moving outwardly to pass the locking shoulder 523. When the inward pressing force on the crown member 53 is relieved, the resilient element 55 is arranged to exert the outward urging force for pushing the pusher cap 54 and the crown member 53 back to their original position (i.e. the idle position). Moreover, relative rotational movement between the pusher cap 54 and the stem driving member 52 can be prevented by the hexagonal engagement between the outer surfaces 521 of the stem driving member 52 and the surrounding sidewalls 5431 of the pusher cap 54.

The multi-functional actuator 50 further comprises guider element 56 provided between the crown member 53 and the pusher cap 54 for guiding a sliding movement of the crown member 53 with respective to the casing 10. More specifically, the guider element 56 is also tubular in structure having an enlarged portion 561 and received in the crown cavity 531 of the crown member 53, and a contracted portion 562 integrally extended from the enlarged portion 561, wherein the crown member 53 has an engagement ridge 532 arranged to be in sliding engagement with the contracted portion 562 of the guider element 56 when moving between the idle position, the triggering position and the time adjustment position. When the actuator button 51 is in the time adjustment position, the engagement ridge 532 is arranged to engage with the intersection between the enlarged portion 561 and the contracted portion 562 so as to restrict a further movement of the crown member 53.

Moreover, the multi-functional actuator 50 further comprises a sealing ring 57 provided on the pusher cap 54 for sealing the multi-functional actuator 50 from external environment.

The operation of the present invention is as follows: the actuator button 51 is normally retained at the idle position. When the user wishes to perform time adjustment, he or she needs to hold the crown member 53 and exert an outward pulling on the crown member 53. This outward pulling force is then transmitted to the pusher cap 54 which then drives the stem driving member 52 to move outwardly as well because of the engagement between the stem driving member 52 and the pusher cap 54 at the locking shoulder 523 and the locking latch 544. Since inner driven portion 521 of the stem driving member 52 securely engages with the adjustment stem 22 of the timepiece core assembly 21, the outward pulling force will cause the adjustment stem 22 to move outwardly so as to temporarily stop the operation of the timepiece core assembly 21. When this happens, the actuator button 51 is at the time adjustment position. The user is able to rotate the crown member 53. This rotational movement is then transferred to the pusher cap 54 and then to the stem driving member 52 for rotating the adjustment stem 22 of the timepiece core assembly 21. When the time adjustment has completed, the user needs to inwardly push the crown member 53 so as to push the adjustment stem 22 back to its original position through the pusher cap 54 and the stem driving member 52 for resuming a normal operation of the timepiece core assembly 21.

When the user wishes to actuate the electronic device 30, the user needs to coaxially and inwardly push the crown member 53 to the triggering position. This inward pushing force will drive the pusher cap 54 to move inwardly as well. However, because of the unidirectional locking mechanism at the locking shoulder 523 and the locking latch 544, the stem driving member 52 will not be pushed inwardly by this inward pushing force. Rather, the pusher cap 54 is inwardly moved to push the loose end portion 1332 of the conductive element 133. The conductive element 133 will then be pushed to be in physical contact with the signal port 421 of the PCB 42. This physical contact between the conductive element 133 and the PCB 42 will generate a signal for the main processor 41 of the MCU to actuate the operation of the electronic device 30.

One skilled in the art will appreciate that the embodiment of the present invention as shown in the drawings and described above is illustrative only and not intended to be limiting. All embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An analog timepiece, comprising:

a casing having a receiving cavity, and comprises an inner supporting frame defining a triggering slot, and a conductive element, having a fixed and portion and a loose end portion, mounting at said inner supporting frame at a position in a vicinity of said triggering slot;

a time displaying device which comprises a time core assembly and an adjustment stem extended from said timepiece core assembly for indicating time information;

an electronic device received in said casing;

a main control unit (MCU) received in said easing and communicated with said electronic device for selectively controlling an operation of said time displaying device and said electronic device, wherein said MCU comprises a central processor and a Printed Circuit Board (PCB) electrically connecting said central processor with said electronic device, wherein said PCB has a signal port provided at a position aligning with said conductive element; and a multi-functional actuator which comprises an actuator button movably provided on said casing to selectively move between an idle position, a time adjustment position and a triggering position, wherein in said idle position, said actuator button disengages with said MCU to allow normal operation of said electronic device, wherein in said time adjustment position, said actuator button is moved from said idle position to allow adjustment of said time displaying device, and wherein in said triggering position, said actuator is moved to actuate an operation of said electronic device, wherein said conductive element is arranged to be selectively driven to trigger an operation of said electronic device when said actuator button is at said triggering position, wherein said conductive element has a predetermined amount of resilient ability such that said conductive element is normally retained to disengage from said electronic device, wherein when said actuator button is pushed to said triggering position, said actuator button is driven to move said conductive element to electrically communicate with said electronic device so as to trigger an operation thereof, wherein when said conductive element is pushed by said actuator button at said triggering position, said conductive element is arranged to be in physical contact with said signal port of said PCB so as to generate an actuation signal for said main processor of said MCU to actuate said electronic device, wherein said actuator button comprises a stem driving member securely connected with an outer end of said adjustment stem of said time displaying device, an enlarged crown member for allowing a user to manually drive said actuator button to move between said idle position, said time adjustment position and said triggering position for selectively handling time adjustment and actuation of said electronic device, and a pusher cap operatively connecting between said crown member and said stem driving member, wherein said crown member has a substantially circular cross section and defines a crown cavity therewithin, wherein said pusher cap has an outer receiving portion received within said crown cavity of the crown member, and an inner engaging portion, integrally and coaxially extended out of said crown cavity, wherein said pusher cap has an elongated structure and an external circular cross section extended from said crown member to securely engage with said stein driving member, in such a manner that when said pusher cap is driven to move inwardly, an inner end of said inner engaging portion is arranged to inwardly push said conductive element to physically contact with said signal port of said PCB for triggering an operation of said electronic device, wherein said fixed end portion of said conductive element is affixed at a predetermined position of said inner supporting frame, wherein said loose end portion is movably extended to contact with said inner end of said inner engaging portion of said pusher cap, and is normally arranged to disengage with said PCB, and when said pusher cap is driven to move inwardly, said loose end portion is slightly pushed to deform to move to contact with said signal port of said PCB, wherein said multi-functional actuator further comprises a resilient element received in said pusher cap, which is cylindrical in shape having a pusher cavity extended along an entire longitudinal length thereof and defined by six surrounding sidewalls for forming a hexagonal pusher cavity, wherein said resilient element is received therein for normally exerting an outward urging force towards said crown member so as to normally retain said actuator button at said idle position.

2. The analog timepiece, as recited in claim 1, wherein said pusher cap further has a locking latch integrally and inwardly extended from an inner side edge of said inner engaging portion, wherein said stem driving member has an inner driven portion and an outer driving portion having a diameter slightly larger than a diameter of said inner driven portion to define a locking shoulder at an intersection between said inner driven portion and said outer driving portion, wherein said locking shoulder is arranged to align with said locking latch of said pusher cap so that when said pusher cap is outwardly pushed with respective to said casing, said outward movement of said pusher cap is blocked by engagement between said locking shoulder and said locking latch.

3. The analog timepiece, as recited in claim 2, wherein said stem driving member further has six outer surfaces formed at said inner driving portion for forming a corresponding hexagonal outer contour, wherein said hexagonal contour is arranged to fittedly and slidably receive in said inner engaging portion so that said pusher cap is capable of being inwardly moved to drive said conductive, element yet is prevented from moving outwardly to pass said locking shoulder, wherein relative rotational movement, between said pusher cap and said stem driving, member is prevented by said hexagonal engagement between said outer surfaces of said stem driving member and said surrounding sidewalls of said pusher cap.

4. The analog timepiece, as recited in claim 3, wherein said multi-functional actuator further comprises guider element provided between said crown member and said pusher cap for guiding a sliding movement of said crown member with respective to said casing.

5. The analog timepiece, as recited in claim 2, wherein said multi-functional actuator further comprises a sealing ring provided on said pusher cap for sealing said multi-functional actuator from external environment.

6. The analog timepiece, as recited in claim 3, wherein said multi-functional actuator further comprises a sealing ring provided on said pusher cap for sealing said multi-functional actuator from external environment.

7. The analog timepiece, as recited in claim 4, wherein said multi-functional actuator further comprises a sealing ring provided on said pusher cap for sealing said multi-functional actuator from external environment.

8. An analog timepiece, comprising:

a casing having a receiving cavity, and comprises an inner supporting frame defining a triggering slot, and a conductive element mounting at said inner supporting frame at a position in a vicinity of said triggering slot;

a time displaying device which comprises a time core assembly and an adjustment stem extended from said timepiece core assembly for indicating time information;

an electronic device received in said casing;

a main control unit (MCU) received in said casing and communicated with said electronic device for selectively controlling an operation of said time displaying device and said electronic device, wherein said MCU comprises a central processor and a Printed Circuit Board (PCB electrically connecting said central processor with said electronic device, wherein said PCB has a signal port provided at a position aligning with said conductive element; and a multi-functional actuator which comprises an actuator button movably provided on said casing to selectively move between an idle position, a time adjustment position and a triggering position, where in said idle position, said actuator button disengages with said MCU to allow normal operation of said electronic device, wherein in said time adjustment position said actuator button is moved from said idle position to allow adjustment of said time displaying device, and wherein in said triggering position, said actuator is moved to actuate an operation of said electronic device, wherein said conductive element is arranged to be selectively driven to trigger an operation of said electronic device when said actuator button is at said triggering position, wherein said conductive element has a predetermined amount of resilient ability such that said conductive element is normally retained to disengage from said electronic device, wherein when said actuator button is pushed to said triggering position, said actuator button is driven to move said conductive clement to electrically communicate with said electronic device so as to trigger an operation thereof, wherein when said conductive element is pushed by said actuator button at said triggering position, said conductive element is arranged to be in physical contact with said signal port of said PCB so as to generate an actuation signal for said main processor of said MCU to actuate said electronic device, wherein said actuator button comprises a stem driving member securely connected with an outer end of said adjustment stern of said time displaying device, an enlarged crown member for allowing a user to manually drive said actuator button to move between said idle position, said time adjustment position and said triggering position for selectively handling time adjustment and actuation of said electronic device, and a pusher cap operatively connecting between said crown member and said stem driving member, wherein said crown member has a substantially circular cross section and defines a crown cavity therewithin, wherein said pusher cap has an outer receiving portion received within said crown cavity of the crown member, and an inner engaging portion, integrally and coaxial extended out of said crown cavity, wherein said pusher cap has an elongated structure and an external circular cross section extended from said crown member to securely engage with said stem driving member, in such a manner that when said pusher cap is driven to move inwardly, an inner end of said inner engaging portion is arranged to inwardly push said conductive element to physically contact with said signal port of said PCB for triggering, an operation of said electronic device, wherein said pusher cap further has a locking latch integrally and inwardly extended from an inner side edge of said inner engaging portion, wherein said stern driving member has an inner driven portion and an outer driving portion having a diameter slightly larger than a diameter of said inner driven portion to define a locking shoulder at an intersection between said inner driven portion and said outer driving portion, wherein said locking shoulder is arranged to align with said locking latch of said pusher cap so that when said pusher cap is outwardly pushed with respective to said casing, said outward movement of said pusher cap is blocked by engagement between said locking shoulder and said locking latch.

9. The analog timepiece, as recited in claim 8, wherein said stem driving member further has six outer surfaces formed at said inner driving portion for forming a corresponding hexagonal outer contour, wherein said hexagonal contour is arranged to fittedly and slidably receive in said inner engaging portion so that said pusher cap is capable of being inwardly moved to drive said conductive element yet is prevented from moving outwardly to pass said locking shoulder, wherein relative rotational movement between said pusher cap and said stem driving member is prevented by said hexagonal engagement between said outer surfaces of said stem driving member and said surrounding, sidewalk of said pusher cap.

10. The analog timepiece, as recited in claim 9, wherein said multi-functional actuator further comprises guider element provided between said crown member and said pusher cap for guiding a sliding movement of said crown member with respective to said casing.

11. An analog timepiece, comprising:

a casing having a receiving cavity, and comprises an inner supporting frame defining a triggering slot, and a conductive element mounting at said inner supporting frame at a position in a vicinity of said triggering slot;

a time displaying device which comprises a time core assembly and an adjustment stem extended from said timepiece core assembly for indicating time information;

an electronic device received in said casing;

a main control unit (MCU) received in said casing and communicated with said electronic device for selectively controlling an operation of said time displaying device and said electronic device, wherein said MCU comprises a central processor and a Printed Circuit Board (PCB) electrically connecting said central processor with said electronic device wherein said PCB has a signal port provided at a position aligning with said conductive element; and a multi-functional actuator which comprises an actuator button movably provided on said casing to selectively move between an idle position, a time adjustment position and a triggering position, wherein in said idle position, said actuator button disengages with said MCU to allow normal operation of said electronic device, wherein in said time adjustment position, said actuator button is moved from said idle position to allow adjustment of said time displaying device, and wherein in said triggering position, said actuator is moved to actuate an operation of said electronic device, wherein said conductive element is arranged to be selectively driven to triggering an operation of said electronic device when said actuator button is at said triggering position, wherein said conductive element has a predetermined amount of resilient ability such that said conductive element is normally retained to disengage from said electronic device, wherein when said actuator button is pushed to said triggering position, said actuator button is driven to move said conductive element to electrically communicate with said electronic device so as to trigger an operation thereof, wherein when said conductive element is pushed by said actuator button at said triggering position, said conductive element is arranged to be in Physical contact with said signal ort of said PCB so as to generate an actuation signal for said main processor of said MCU to actuate said electronic device, wherein said actuator button comprises a stem driving member securely connected with an outer end of said adjustment stem of said time displaying device, an enlarged crown member for allowing a user to manually drive said actuator button to move between said idle position, said time adjustment position and said triggering position for selectively handling time adjustment and actuation of said electronic device, and a pusher cap operatively connecting between said crown member and said stem driving member, wherein said crown member has a substantially circular cross section and defines a crown cavity therewithin, wherein said pusher cap has an outer receiving portion received within said crown cavity of the crown member, and an inner engaging portion, integrally and coaxially extended out of said crown cavity, wherein said pusher cap has an elongated structure and an external circular cross section extended from said crown member to securely engage with said stem driving member, in such a manner that when said pusher cap is driven to move inwardly, an inner end of said inner engaging portion is arranged to inwardly push said conductive element to physically contact with said signal port of said PCB for triggering an operation of said electronic device, wherein said multi-functional actuator further comprises a resilient element received in said pusher cap, which is cylindrical in shape having a pusher cavity extended along an entire longitudinal length thereof and defined by six surrounding sidewalls for forming a hexagonal pusher cavity, wherein said resilient element is received therein for normally exerting an outward urging force towards said crown member so as to normally retain said actuator button at said idle position, wherein said pusher cap further has a locking latch integrally and inwardly extended from an inner side edge of said inner engaging portion, wherein said stern driving member has an inner driven portion and an outer driving portion having a diameter slightly larger than a diameter of said inner driven portion to define a locking shoulder at an intersection between said inner driven portion and said outer driving portion, wherein said locking shoulder is arranged to align with said locking latch of said pusher cap so that when said pusher cap is outwardly pushed with respective to said casing, said outward movement of said pusher cap is blocked by engagement between said locking shoulder and said locking latch.

12. The analog timepiece, as recited in claim 11, wherein said stem driving member further has six outer surfaces formed at said inner driving portion for forming a corresponding hexagonal outer contour, wherein said hexagonal contour is arranged to fittedly and slidably receive in said inner engaging portion so that said pusher cap is capable of being inwardly moved to drive said conductive element yet is prevented from moving outwardly to pass said locking shoulder, wherein relative rotational movement between said pusher cap and said stem driving member is prevented by said hexagonal engagement between said outer surfaces of said stem driving member and said surrounding sidewalls of said pusher cap.

13. The analog timepiece, as recited in claim 12, wherein said multi-functional actuator further comprises guider element provided between said crown member and said pusher cap for guiding a sliding movement of said crown member with respective to said casing.

* * * * *